US005219182A

United States Patent [19]

Biciolis

[11] Patent Number: 5,219,182

[45] Date of Patent: Jun. 15, 1993

[54] PAPER SAVER AND FORM LEADER

[76] Inventor: Edward P. Biciolis, 108 Stewart St., Freeport, Pa. 16229

[21] Appl. No.: 822,590

[22] Filed: Jan. 17, 1992

[51] Int. Cl.[5] ..... B42D 19/00

[52] U.S. Cl. ..... 281/5; 281/15.1; 281/51; 462/84; 226/91; 226/92; 400/613.1

[58] Field of Search ..... 281/2, 5, 15.1, 51; 226/91, 92; 400/613.1, 616.1, 616, 642; 156/157; 462/84

[56] References Cited

U.S. PATENT DOCUMENTS

| | | | |
|---|---|---|---|
| 3,788,536 | 1/1974 | Brown | 226/91 |
| 4,487,645 | 12/1984 | Weston | 281/2 X |
| 4,545,517 | 10/1985 | Olson | 226/92 |
| 4,660,855 | 4/1987 | Pagliaccio | 281/2 |
| 4,759,484 | 7/1988 | Richter | 226/92 X |
| 5,048,987 | 9/1991 | Golden | 226/92 X |

*Primary Examiner*—Mark Rosenbaum
*Assistant Examiner*—William Fridie, Jr.

[57] ABSTRACT

Disclosed is a paper saver for use with continuous paper forms, the paper saver comprising a generally rectangular shaped flexible sheet having a top and a bottom and two parallel sides defining the rectangular shaped material. The sides extend to provide the material with a width approximate that of the paper forms. The sides of the material have openings therein to engage a drive mechanism and bosses on at least one of the sides to engage the paper form whereby said paper saver can be fed through processing equipment and providing a first part of said paper for information.

6 Claims, 1 Drawing Sheet

PAPER SAVER AND FORM LEADER

INTRODUCTION

This invention relates to continuous forms and a leader for continuous forms for purposes of saving paper.

In previous patents, there are disclosed form leaders. For example, Brown U.S. Pat. No. 3,788,536 discloses a leader for use in the printing of continuous business forms for alignment of the end-most form with a printer. This patent discloses a Y-shaped member with the legs of the member receiving the end-most form. Olson U.S. Pat. No. 4,545,517 discloses a forms leader for use in printing business forms. The leader includes a rectangular sheet of flexible material having a series of line holes formed along the edges of the sheet. The sheet is folded along a crease to define a front portion of the sheet which is of less length than a rear portion. An adhesive strip is formed across the front surface of the rear portion of the sheet. The adhesive has a relatively low tack whereby the form can be removeably secured to the adhesive.

However, it will be seen that there is still a need for a simple, reusable forms leader without need of replacement when the adhesive wears out or collects dust, etc. The present invention provides such a device which may be reused many times without fear of wearout and which also aligns the forms for use in a printer, for example.

SUMMARY OF THE INVENTION

An object of the invention is to provide a paper saver or a form leader for continuous paper, for example, and which permits printing on the end-most part of the continuous paper.

These and other objects will become apparent from the specification, drawings and claims appended hereto.

In accordance with these objects, there is provided a paper saver for use with continuous paper forms, the paper saver comprising a generally rectangular shaped flexible sheet having a top and a bottom and two parallel sides defining the rectangular shaped material. The sides extend to provide the material with a width approximate that of the paper forms. The sides of the material have openings therein to engage a drive mechanism and bosses on at least one of the sides to engage the paper form whereby said paper saver can be fed through processing equipment and providing a first part of said paper for information.

DETAILED DESCRIPTION OF THE PREFERRED EMBODIMENTS

Figure 1:
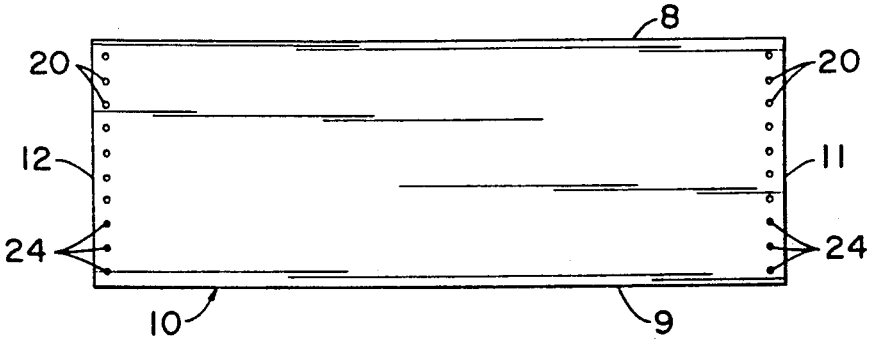
FIG. 1 is a top view of a paper saver or form leader in accordance with the invention.

FIG. 1 provides a top view of a form leader 10 of the present invention. As illustrated, the form leader is generally rectangular and has a top or leading edge 8 and a bottom or trailing edge 9. Further, the form leader has sides 11 and 12 which are generally parallel. On each side of said form leader are defined openings or apertures for engaging the drive mechanism or sprocket of a printer (see FIG. 2). On the illustration in FIG. 1, seven holes or openings (sometimes referred to as pin feed holes) are shown extending from leading top edge 8 towards bottom edge 9 on each side to engage the printer drive mechanism. It will be appreciated that a greater number sprocket engaging means or openings may be provided depending to some extent on the drive mechanism of the printer.

The width of the form leader from side to side is approximately that of the forms with which it is to be used. Further, openings 20 are spaced generally parallel. Additionally, while openings 20 are shown circular, it will be appreciated that other shaped openings can be used as long as sufficient engagement is made with the printer drive mechanism and such other shaped openings are contemplated within the purview of the invention.

On the illustration of the invention in FIG. 1, three bosses 24 are shown in alignment with drive openings 20. The bosses extend from bottom edge 9 towards top edge 8. The bosses are spaced apart along each edge in synchronization with drive openings 20. The bosses are raised portions of the sheet constituting the form leader and may be open or closed. That is, the bosses need only to provide an edge sufficiently high to engage drive openings in the continuous forms. Thus, while the bosses are shown generally circular, it will be understood that other shapes, such as star shape, can be used in accordance with the invention and such are contemplated herein.

For purposes of the present invention, it has been found that bosses protruding about 0.065 inch above the surface of the sheet provide for sufficient engagement with the continuous forms to move the forms though the printer. Further, while three bosses have been shown, it will be appreciated that a greater or lesser number may be used provided sufficient engagement is made with the continuous forms to move them through the printer.

Figure 2:
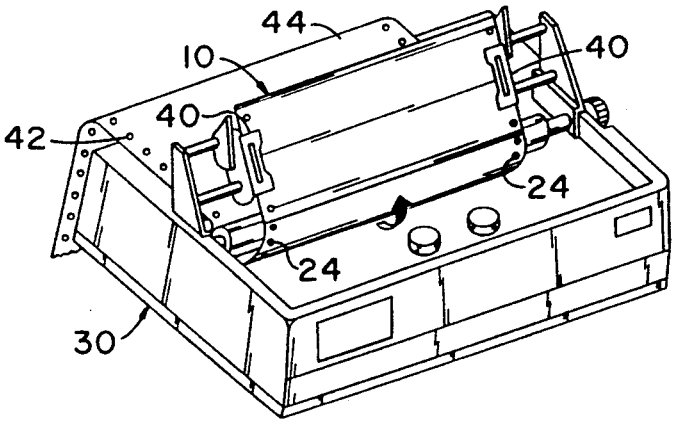
FIG. 2 is a perspective view of a paper saver in the drive mechanism of a printer positioned to permit printing on the forward part of the first form.

For purposes of using form leader 10 with continuous paper, the bosses in the form leader are placed in the pin feed holes of the continuous paper. That is, the form leader is positioned such that the three bosses of the form leader are engaged in the first three pin feed holes and the form leader is then fed through the printer until the forward portion of the first form is in position for printing, as shown in FIG. 2. In FIG. 2, the form leader is shown in use in a printer 30 where the form leader is shown in engagement with drive mechanism 40 of the printer. Further, the form leader is shown with bosses 24 in engagement with pin feed holes 42 in continuous form 44. In addition, continuous form 44 is shown with leading portion 46 available for printing.

Figure 3:
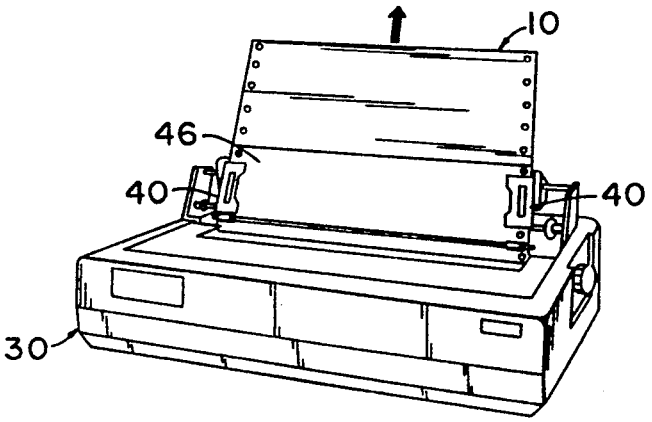
FIG. 3 is a perspective view of the paper saver after it has been fed through a printer.

After the forward portion of the continuous form has been used, the form leader moves through the printer and, as shown in FIG. 3, is in position for removing from the continuous form paper.

The form leader may be fabricated from any type of flexible sheet material such as plastic or nylon which has sufficient stiffness which permits its feeding into a printer, for example. Further, the form leader of the present invention has the advantage that it can be used many times without deterioration in performance. In addition, it is simple and economical to fabricate.

Having thus described the invention, what is claimed is:

1. A paper saver for use with continuous paper forms comprising a generally rectangular shaped flexible material having a top and a bottom and two parallel sides defining said rectangular shaped material, the sides extending to provide said material with a width approximate that of said paper forms; the sides of the material have openings therein to engage a drive mechanism; and bosses on at least one of said sides to engage the paper form, said bosses being in linear relationship with said openings, whereby said paper saver can be fed through processing equipment and providing a first part of said paper from for information.

2. The paper saver in accordance with claim 1 wherein the opening on said sides extend from said top towards said bottom of said flexible material.

3. The paper saver in accordance with claim 1 wherein the bosses are located on both sides.

4. The paper saver in accordance with claim 1 wherein the bosses are synchronized with said openings and extend from said bottom towards said top and are in line with said openings.

5. The paper saver in accordance with claim 1 wherein the bosses are raised portions extending less than 0.25 inch beyond a surface of said material.

6. A paper saver suitable for use with continuous paper forms comprising a generally rectangular shaped flexible material having a top and a bottom and two parallel sides defining said rectangular shaped material, the sides extending to provide said material with a width approximate that of said paper forms, the sides of said material having perforations therein to engage a drive mechanism and extending from the top towards the bottom of said material and bosses in alignment with said perforations and spaced in synchronization therewith extending from the bottom of said material towards the top thereof, the bosses suited to engage perforations in said paper forms thereby freeing the initial part of said paper forms for information.

* * * * *